US010669730B1

(12) United States Patent
Taylor

(10) Patent No.: US 10,669,730 B1
(45) Date of Patent: Jun. 2, 2020

(54) METHOD AND APPARATUS FOR REPAIRING RETAINING WALLS

(71) Applicant: Dirk A. Taylor, Pittsburgh, PA (US)

(72) Inventor: Dirk A. Taylor, Pittsburgh, PA (US)

( * ) Notice: Subject to any disclaimer, the term of this patent is extended or adjusted under 35 U.S.C. 154(b) by 0 days.

(21) Appl. No.: 16/194,530

(22) Filed: Nov. 19, 2018

(51) Int. Cl.
*E04G 23/02* (2006.01)
*E04G 23/04* (2006.01)

(52) U.S. Cl.
CPC ..... *E04G 23/0229* (2013.01); *E04G 23/04* (2013.01)

(58) Field of Classification Search
CPC . E04G 23/0229; E04G 23/04; E04G 23/0218; E04G 23/02; E02D 37/00
USPC ..... 52/514
See application file for complete search history.

(56) References Cited

U.S. PATENT DOCUMENTS 3,537,220 A 11/1970 Ellis
3,852,970 A * 12/1974 Cassidy ..... E02D 27/48 405/230
5,115,622 A * 5/1992 Ammann ..... E04G 23/0218 52/231
5,234,287 A * 8/1993 Rippe, Jr. ..... E02D 27/48 405/230
5,845,450 A * 12/1998 Larsen ..... E02D 35/00 52/574
6,357,190 B1 * 3/2002 Florentine ..... E02D 37/00 248/351
7,296,385 B2 * 11/2007 Andra ..... E04C 5/127 52/223.13
7,380,372 B2 * 6/2008 Resch ..... E04G 23/0229 52/127.2
7,419,335 B1 * 9/2008 Cohen ..... E04G 23/0218 248/351
7,774,995 B1 * 8/2010 Zidar, Jr. ..... E02D 31/10 52/127.2
8,136,317 B1 * 3/2012 McCown ..... E02D 35/00 52/291
8,925,267 B1 * 1/2015 Kirby ..... E04G 23/0218 248/354.3
2005/0204673 A1 * 9/2005 Reed ..... E04G 23/0229 52/514
2009/0193736 A1 * 8/2009 Halfon ..... E06B 3/4636 52/291

* cited by examiner

*Primary Examiner* — Brian D Mattei
(74) *Attorney, Agent, or Firm* — Carothers & Carothers

(57) ABSTRACT

A system for repairing masonry and concrete retaining walls that are failing under lateral earth pressure applied to the outer wall surface of the failing wall. Upper and lower spaced anchor plates are secured to the inner wall surface of the failing wall by respectfully securing the anchor plates to the inner wall surface with at least one anchor bolt. A threaded steel tension rod is then connected between the upper and lower anchor plates with nuts threadably secured to upper and lower ends of the rod. The threaded steel tension rod is placed under a desired tension load to thereby apply an external tension forced to the inner wall surface without applying bending stresses to the threaded steel rod by tightening at least one of the nuts.

9 Claims, 6 Drawing Sheets

8 KIP ANCHOR

8 KIP ANCHOR

4 KIP ANCHOR

4 KIP ANCHOR

2 KIP ANCHOR

2 KIP ANCHOR

METHOD AND APPARATUS FOR REPAIRING RETAINING WALLS

BACKGROUND OF THE INVENTION

At the present time, specialty contractors typically employ one of three commonly used methods to repair cracked and bowed basement walls, depending upon the contractor's personal preference and experience, as well as the specific conditions involved with each installation. The three commonly used methods include earth anchors, vertical steel I-beams, and carbon fiber straps.

Earth anchors consist of a series of steel plates positioned on the inner surface of a failing basement retainment wall. The plates are held in place by long steel tension rods that extend through pre-drilled holes in the wall to another steel plate buried in the soil outside the wall. This method requires considerable installation time and cost, and requires disruption to outside lawn, shrubbery or pavement. In addition, earth anchors are not supported by actual engineering design.

Earth anchors rely on a design process that is fundamentally unsound from an engineering standpoint as it uses a series of relatively small steel plates embedded in the soil outside the house to stabilize much larger sections of wall. It is based on soil pressing against the small plates to resist the same soil pressure against the much larger basement wall. This method cannot be mathematically proven to work using accepted engineering standards. In addition, earth anchors require a significant amount of space outside the house, making it non-useable in many locations with existing obstructions or tight property lines.

While earth anchors are known to be generally effective in many installations and sometimes come with reasonably good warranties, their higher cost, invasive installation requirements, lack of reliability and lack of flexibility are cause for concern.

With the vertical steel I-beam method, a series of vertical steel I-beams are installed along the inside surface of a failing basement wall to stabilize that wall against outside soil pressure. This option requires removal and subsequent replacement of portions of the existing concrete floor slab and finished ceiling at each installation point, requiring increased installation time and cost. Furthermore, the I-beams extend relatively far out into the basement space.

The carbon fiber strap repair method uses a series of "high-tech" carbon fiber straps installed along the inside surface of a failing basement wall to stabilize that wall against outside soil pressure. While the carbon fiber strap repair method clearly works well in certain circumstances, its cost and limitations make it undesirable. The carbon fiber strap repair method has a high installation cost and is not applicable for use on walls which are extensively bowed.

Actually, none of these prior art methods can move the bowed wall back into its original straight and plum condition over time. It is a principal object of the present invention to provide a system which eliminates these foregoing disadvantages of the prior art systems.

SUMMARY OF THE INVENTION

The system of the present invention for repairing retaining walls failing under lateral earth pressure to the outer wall surface of the failing wall is comprised of securing upper and lower spaced anchor plates to the inner wall surface of the failing wall by respectively securing upper and lower anchor plates to the inner wall surface of the failing wall with at least one anchor bolt. A threaded steel tension rod is connected between and respectively connected to these upper and lower anchor plates with nuts threadably secured to upper and lower ends of the threaded steel tension rod. Thereafter the threaded steel tension rod is placed under a desired tension load to thereby apply an external tension force to the inner wall surface of the failing wall without applying bending stresses to the threaded steel tension rod. This is accomplished by tightening at least one of the nuts.

Side-by-side multiples of this anchor plate and tension rod combination are applied at spaced intervals to the inner wall surface of the failing wall.

The upper and lower spaced anchor plates are each secured to the inner wall surface of the failing wall with at least one anchor bolt. These anchor bolts are preferably either expansion anchor bolts or adhesive anchor bolts, which have a very high shear capacity and provide very secure attachment of the anchor plates to the masonry surface and insure that no bending stresses will be applied to the threaded steel tension rod.

The method of the present invention can be mathematically proven to work using accepted engineering standards. In fact, the requirements for the tension rods and the anchors can be readily calculated for each application.

The required size of the threaded tension rod for overcoming the tension overstress on the inner wall surface of the failing wall is determined by calculating the tension rod force per rod required to overcome the tension overstress on the inner wall surface, and then calculating the required cross-sectional area of the threaded tension rod. Thereafter the correct tension rod may be selected from standard sizes available by using known allowable tension stress capabilities for a standard steel threaded rod size.

The bolting requirements for the anchor-to-wall shear connection of the anchor plates to the inner wall surface is accomplished by calculating the total anchor load and then selecting the anchor bolt or anchor bolts size from a known shear capacity.

Additional novelty of the system of the present invention is further provided by providing multiple designs of the claimed anchor plate and tension rod combination for respective corresponding different tension rod tension load requirements, and then selecting the combination designed for securement for the inner wall surface which most closely fits the calculated rod tension load requirements.

For example, three different anchor and tension rod designs could be pre-designed for application to three different required tension rod tension loads of for example, up to 2,000 pounds, up to 4,000 pounds, and up to 8,000 pounds, thereby greatly simplifying the procedure for the contractor. The contractor simply selects which anchor and tension rod combination is the most appropriate for the wall condition and the calculated required anchor spacing based on the unit tension previously calculated.

The method and apparatus of the present invention for repairing retaining walls failing under lateral earth pressure is far superior to the prior art systems in that the method can be mathematically calculated and proven by accepted engineering standards, the system is much less expensive for installation and manufacture costs, no disturbances required to outside lawn, shrubbery or pavement, and the protrusion of the system into useable basement area is minimal. In addition, the system of the present invention is actually capable of ultimately moving the bowed wall back into its original straight and un-bowed condition over time, which is not possible by the aforementioned prior art systems.

DISCUSSION OF RELATED PRIOR ART

Some similarities exist to the prior system disclosed in U.S. Pat. No. 5,537,220, for MASONRY WALL BRACE, by J. P. Ellis, which issued on Nov. 3, 1970. This masonry wall brace system uses tension rods applied to the inner surface of a basement retaining wall to resist cracking and bowing. However, there are key differences to the system of the present invention, including design capabilities, installation methods, and load capacity that distinguish the method of the present invention as a very different and superior system.

The system of the present invention is an engineered system that is specifically designed to resist the actual lateral earth pressure loads that are applied to a basement retaining wall based on the actual conditions that apply to each individual case. The Ellis system does not provide any method of determining the necessary tension rod size and spacing, and also does not include any specific design parameters for the top and bottom anchorages. The Ellis system simply does not provide any information regarding how to design the system for a given application.

The system design of the present invention is mechanically anchored to the masonry wall in a manner designed to ensure that the steel rods are only loaded in pure tension. To the contrary, the Ellis anchorage design results in both tension and bending loads being applied to the steel tension rods. The slender tension rods have the inherent ability to resist very high tension loads, but very little ability to resist bending loads. Therefore, when bending loads are considered, their tension load capacity is greatly reduced.

In addition, the bottom anchorage of the Ellis system is connected to the masonry by notching into a horizontal mortar joint. It is therefore held in place by friction and lever action that cannot be specifically designed for each individual installation and has an extremely limited load capacity. To the contrary, the bottom anchorage of the system of the present invention is fastened to the masonry wall with positively connected masonry anchors that are specifically designed for each individual installation based on the actual conditions. The bottom connections of the system of the present invention can be specifically designed to provide much greater load capacity than that of the Ellis system.

Also, the top anchorage of the Ellis system is connected to the masonry wall with overlapped angles or hooks that are also held in place by friction and lever action that is not specifically designed for each individual installation and has an extremely limited load capacity. This top anchorage, like his bottom anchorage, applies unwanted bending loads to the tension rod. In addition, the Ellis anchorages are more difficult to install and his upper anchorage is designed such that in many conditions his design cannot even be installed due to the fact that his upper anchorage is required to overlap the top of the failing masonry wall.

With the system of the present invention, like the bottom anchorage, the top anchorage of the system of the present invention is fastened to the masonry with positively connected masonry anchors that are specifically designed for each individual installation based on the actual existing conditions and provide much greater load capacity.

BRIEF DESCRIPTION OF THE DRAWINGS

Other objects and advantages appear hereinafter in the following description and claims. The accompanying drawings show, for the purpose of exemplification, without limiting the scope of the present invention or the appended claims, certain practical embodiments of the present invention wherein:

DETAILED DESCRIPTION

The system of the present invention is an improved method of repairing masonry and concrete retaining walls that are failing under lateral earth pressure. The system consists of a series of threaded steel tension rods anchored to the inner surface of a below grade (basement) retaining wall that is cracking and bowing inward as a result of lateral earth pressure applying horizontal force against the outer surface of that wall. It works by applying external tension forces to the inner wall surface to counteract calculated internal tension forces that have developed in the masonry or concrete as a result of bending from the lateral earth pressure, to stabilize the wall and correct the problem. Through proper design and installation, this system can even be used to re-straighten bowed walls back into their original "un-bowed" condition. While other wall repair systems claim to have the ability to straighten bowed walls, only the system of the present invention can truly perform this function. And while earth anchor systems are based on empirical designs that do not utilize sound engineering criteria, all components of this system are properly designed for their specific requirement through standard calculations, based on established engineering procedures and material properties.

Lateral Earth Pressure: Horizontal forces applied against the outer surface of a below-grade (basement) retaining wall by lateral earth pressure can easily be calculated, based on the following four measurable parameters:

1. The wall height ($h_w$) from basement floor slab to first floor structure,
2. The height of soil ($h_s$) pressing against the outer surface of the wall,
3. The density of the soil ($D_S$) pressing against the outer surface of the wall, and 4. The at rest pressure coefficient ($K_o$) of the soil pressing against the outer surface of the wall.

Density and at rest pressure coefficient are functions of the existing soil type (clay, sand, gravel, rock, etc.) where the wall is located, while the wall and soil heights are based on the actual wall conditions. Once these four critical parameters are established, the lateral pressure being applied to the outer surface of the wall can be calculated using standard engineering formulas. First, the soil density must be converted to an equivalent fluid density ($D_e$) using the following equation:

$$\text{Equivalent Fluid Density of Soil: } D_e = K_o D_s$$

The magnitude of horizontal pressure applied by the soil to the wall ($P_s$) is based on the height of soil pressing against the wall. It varies linearly from zero at the ground surface, to maximum at the base of the wall, in accordance with the following formula:

$$\text{Horizontal Pressure Against Wall: } P_s = h_s D_e$$

Figure 1:
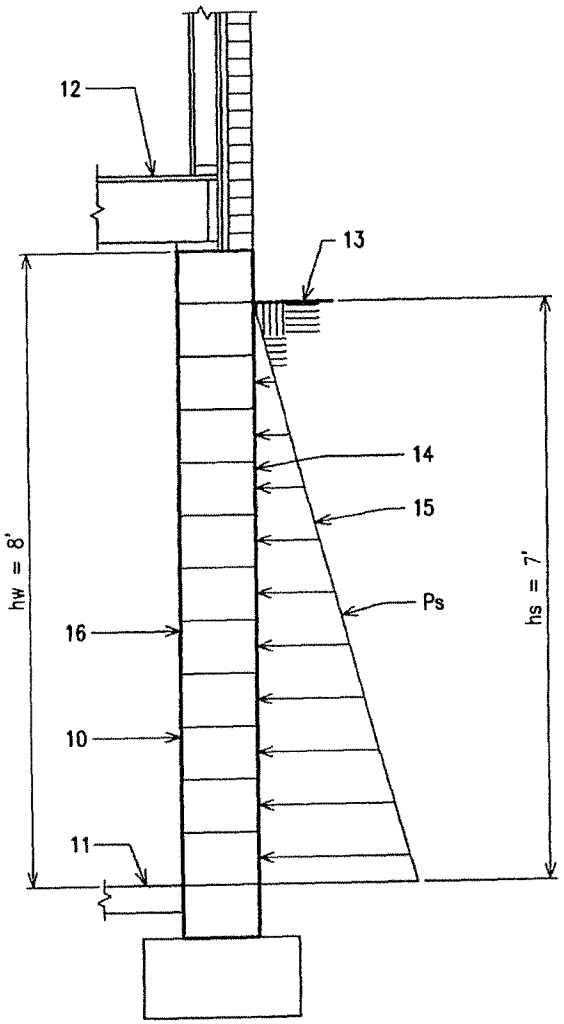
FIG. 1 is a schematic vertical sectional view of a concrete block type basement wall illustrating how lateral earth pressure is distributed against the basement retaining wall.

FIG. 1 illustrates how lateral earth pressure is distributed against a basement retaining wall. The basement retaining wall 10 vertically extends a height $h_w$ from the basement floor slab 11 to the first floor structure 12. $h_s$ represents the height of soil from the floor slab 11 to the ground surface 13 pressing against the outer wall surface 14 as represented by the pressure $P_s$ gradient arrows 15.

Figure 2:
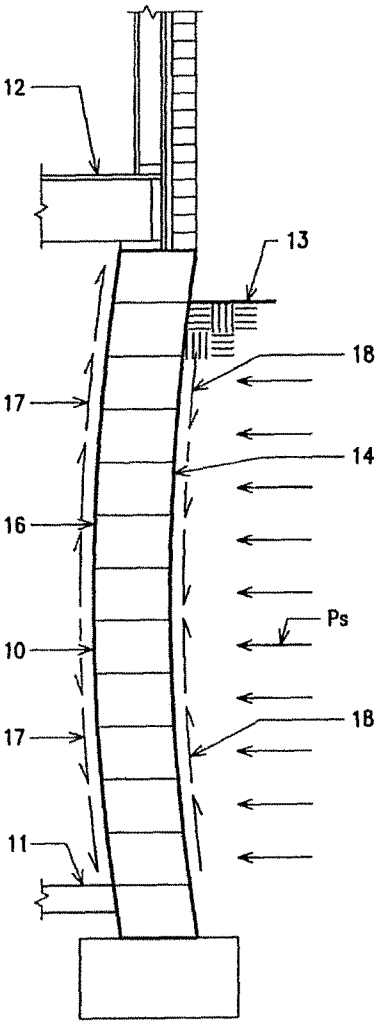
FIG. 2 illustrates the concrete block basement wall shown in FIG. 1 with applied bending stresses on the inner and outer wall surfaces resulting from lateral earth pressure.
Figure 3:
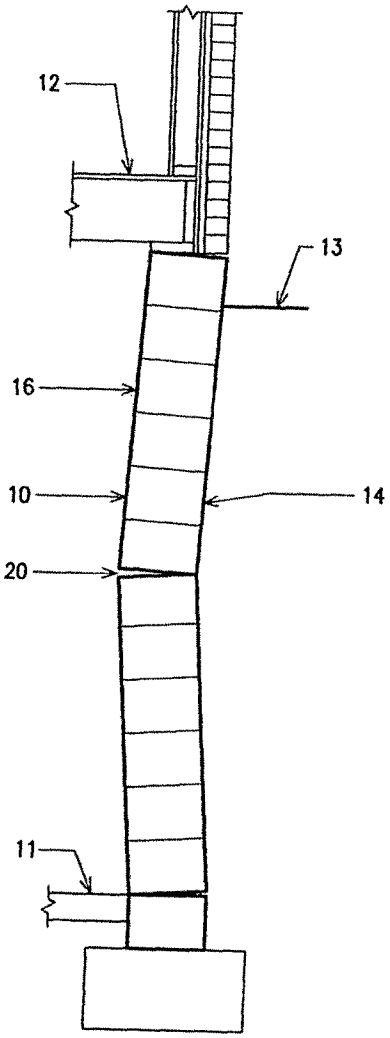
FIG. 3 illustrates the basement retaining wall of FIGS. 1 and 2 with ultimate damage caused to the wall in the form of a horizontal crack caused by the lateral earth pressure stresses that are applied to the wall as illustrated in FIG. 2.

The horizontal pressure applied by the soil to the outer surface of the wall creates shear and moment forces in the wall that can be calculated based on the factors previously described. While some basement wall failures occur as a result of shear forces, most are caused by overstress from moment loads. Moment forces create bending in the wall, resulting in compressive stress on the outer wall surface (adjacent to the soil) and tension stress on the inner wall surface (facing away from the soil). While masonry has an excellent ability to resist compression stress, it has very little ability to resist tension stress. Therefore, most basement wall failures occur on the inner wall surface 16, which is literally pulled apart by tension, causing cracks 20 to form and horizontal inward movement of the wall (bowing) to occur, as illustrated in FIGS. 2 and 3, which illustrates bending stresses in the failing wall 10 from lateral earth pressure. Tension stresses 17 are applied to the inner wall surface 16, and compression stresses 18 are applied to the outer wall surface 14.

The system of the present invention works to correct the wall failure by applying external tension strength at the cracked inner wall surface that counteracts the tension forces that have caused the wall to crack and bow inward. And because the present system is an engineered system, it can be specifically designed to resist the actual tension forces in any given basement wall through standard calculation. The following example describes exactly how this works.

System Design Example:

Problem:

Calculate the tension rod, anchor, and anchor-to-wall requirements for an existing basement wall with the following parameters:

| | |
|---|---|
| Wall height: | $h_w$ = 8'-0" |
| Outside Soil height: | $h_s$ = 7'-0" |
| Soil density: | Ds = 110 pcf (pounds per cubic foot) |
| At rest pressure coefficient: | $K_o$ = 0.60 (clay soil) |
| Concrete block thickness: | t = 10" |

See FIG. 1. (All of these parameters are fairly common for residential construction in the northeastern region of the United States.)

Solution:

1. Calculate the Equivalent Fluid Density ($D_e$) of Soil:

$$D_e = K_o D_s = 0.60(110 \text{ pcf}) = 66 \text{ pcf}$$

2. Calculate the horizontal soil pressure ($P_s$) against the wall:

| | |
|---|---|
| | $P_s = h_s D_e = h_s(66 \text{ pcf})$ |
| At base of wall: | $P_s$ = 7.0'(66 pcf) = 462 psf (pounds per square foot) |
| At top of soil: | $P_s$ = 0.0'(66 pcf) = 0 psf |

3. Calculate the maximum shear force ($V_{max}$) and maximum shear stress (vmax) at the base of the wall.

$$V_{max} = (h_s D_e) \times (h_s/2) \times [h_w - (h_s/3)]/h_w$$
$$= (7.0' \times 66\ pcf) \times (7.0'/2) \times [8.0' - (7.0'/3]\}/8.0'$$
$$= 1{,}145.4 \text{ lb/ft}$$
$$v_{max} = V_{max}/\text{surface area of } 10'' \text{ concrete block}$$
$$= (1{,}145.4 \text{ lb/ft})/(47.7 \text{ in}^2/\text{ft})$$
$$= 23\ psi$$

The calculated shear stress of 23 psi in the concrete block is an acceptable shear stress for unreinforced cmu. Therefore, shear is not a problem in this wall.

4. Calculate the maximum moment ($M_{max}$) in the wall:

$$M_{max} = 0.128 \times (h_s D_e) \times (h_s/2) \times h_w$$
$$= 1{,}656 \text{ ft-lb/ft}$$

5. Calculate tension stress ($f_b$) in cmu from bending, based on unreinforced block:

$$f_b = M_{max}/S = (1{,}656 \text{ ft-lb/ft}) \times (12''/\text{ft})/163 \text{ in}^3 = 122 \text{ psi}$$

The maximum allowable tension bending stress in unreinforced cmu is typically taken to be about 25 psi, which is substantially lower than the calculated bending tension stress of 122 psi. Therefore, as expected, the wall fails as a result of bending overstress on the inner wall surface.

Figure 4:
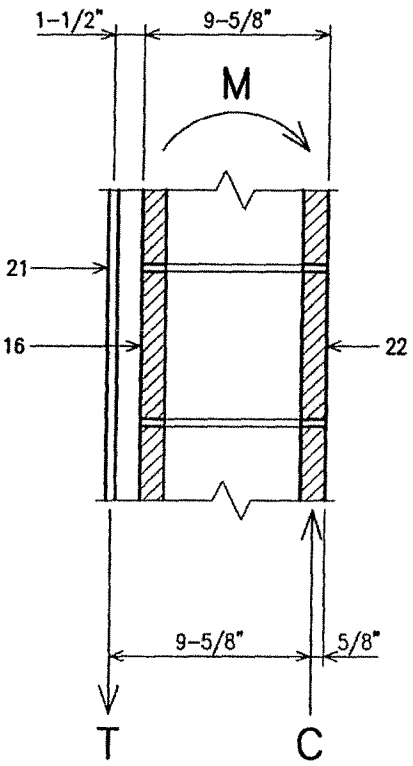
FIG. 4 is an enlarged schematic view illustrating the steel tension rod and a concrete masonry unit of the wall of FIG. 1 shown in vertical cross section to illustrate the tension and compression forces in the tension rod and the block.

6. Calculate required steel tension rod 21 size and spacing to overcome the tension overstress on the inner wall surface 16. See FIG. 4 wherein concrete masonry unit 22 has the indicated dimensions and M represents the moment.

$$\text{Tension } (T) = \text{Compression } (C) = M_{max}/d$$

$$T = C = (1{,}665 \text{ ft-lb/ft}) \times (12''/\text{ft})/10.5'' = 1{,}903 \text{ lb/ft}$$

Assuming a convenient rod spacing of 24" on center (which works well with concrete block dimensions), the tension rod force ($T_{per\ rod}$) would be:

$$T_{per\ rod} = (1{,}903 \text{ lb/ft}) \times (2') = 3{,}806 \text{ pounds per rod.}$$

Using standard steel rods (ASTM A307 or A36 steel), with an allowable tension stress of 20 ksi (kips per square inch), calculate the required cross-sectional area of the rod ($A_{rod}$):

$A_{rod}$=3,806 pounds per rod/20 ksi=0.19 square inches

A ½" diameter rod has a cross-sectional area of 0.196 square inches.

Therefore, use diameter rods at 24" on center.

7. Calculate tension rod anchorage requirements:

a. Bolting requirements for anchor-to-wall shear connection:

Total anchor load: 3,806 pounds

Hollow, un-grouted concrete block: use Hilti HLC sleeve anchors (or equivalent)

½" diameter sleeve anchor: shear capacity=1,125 pounds in hollow cmu (per published manufacturer product information)

Number of anchors=3,806 pounds/(1,125 pounds per anchor)

=3.38 anchors

Figure 5:
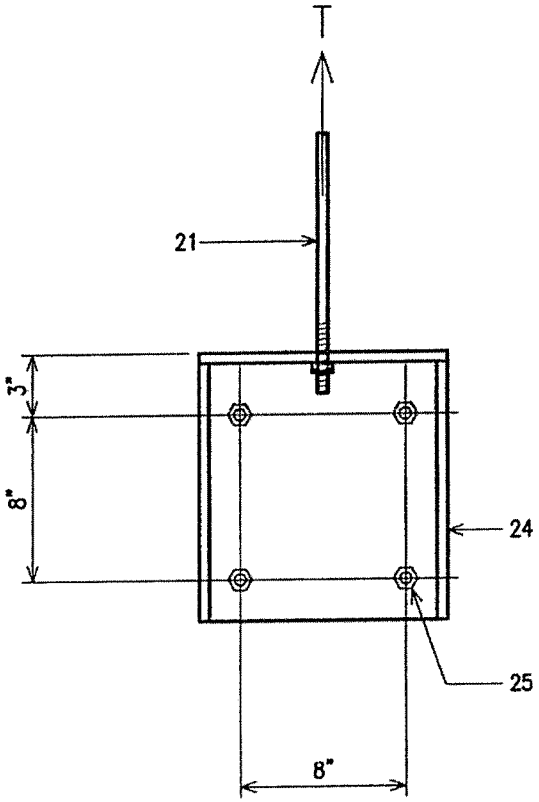
FIG. 5 is an enlarged schematic view of one embodiment of the lower anchorage devise of the present invention.

Therefore, use four ½" diameter Hilti (trademark) HLC sleeve anchors 25 (or equivalent)

b. Anchor design:

Due to anchor spacing requirements, the sleeve anchors need to be spaced a minimum distance of 8" from each adjacent anchor. Therefore, use a standard 12" channel as the anchoring device 24, as shown in FIG. 5.

Calculate the required connection plate thickness of anchoring device 24 where the steel rod 21 connects to the channel.

$$M_{pl} = (3{,}806\ \text{lbs})(12'\text{-}1'')/4$$
$$= 1{,}467\ \text{in-lb}$$
$$f_b = 0.75F_y = 0.75(36\ Ksi) = 27\ ksi$$
$$S_{min} = (1{,}467\ \text{in-lb})/(27\ ksi) = 0.39\ \text{in}^3$$
$$S = bt^2/6$$
$$B = 2.5''$$
$$t_{min} = [(0.39\ \text{in}^3)\times 6/2.5'']^{0.5} = 0.96''$$

Use 2 1/2" × 1" plate

Conclusion: Use ½" diameter steel rods space at 24" on center and anchored to wall with C12×20.7 steel channels with 1"×2½" end plates, and with each channel bolted to the concrete block with four ½" diameter Hilti HLC sleeve anchors or equivalent fasteners.

Figure 6:
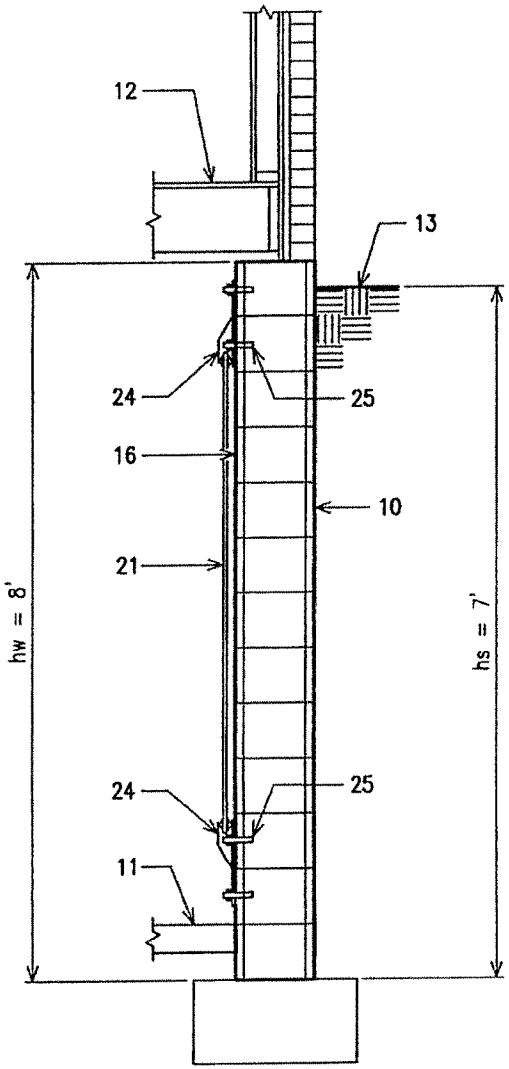
FIG. 6 schematically illustrates the basement wall shown in FIG. 1 with the apparatus of the present invention applied to the basement retaining wall and further illustrating the wall as being straightened or corrected after application of the system of the present invention.

The completed design is shown in FIG. 6. While this example covers many standard residential basement retaining wall conditions, the same simple process can be used to size a system of the present invention for repair for virtually any basement wall that is subjected to lateral earth pressure and braced along the top (by floor framing above) by modifying the tension rod and anchorage requirements.

An additional novel feature of the present invention is that multiple designs of the anchor plate and tension rod combination may be precalculated and provide for respective corresponding different tension rod tension load requirements. Then the contractor has the easy decision of selecting the combination design for securement to the inner wall surface which most closely fits the calculated rod tension load requirements. An example of this design approach is described hereinafter with reference to FIGS. 7A and 7A', 7B and 7B', and 7C and 7C'.

Figure 7A:
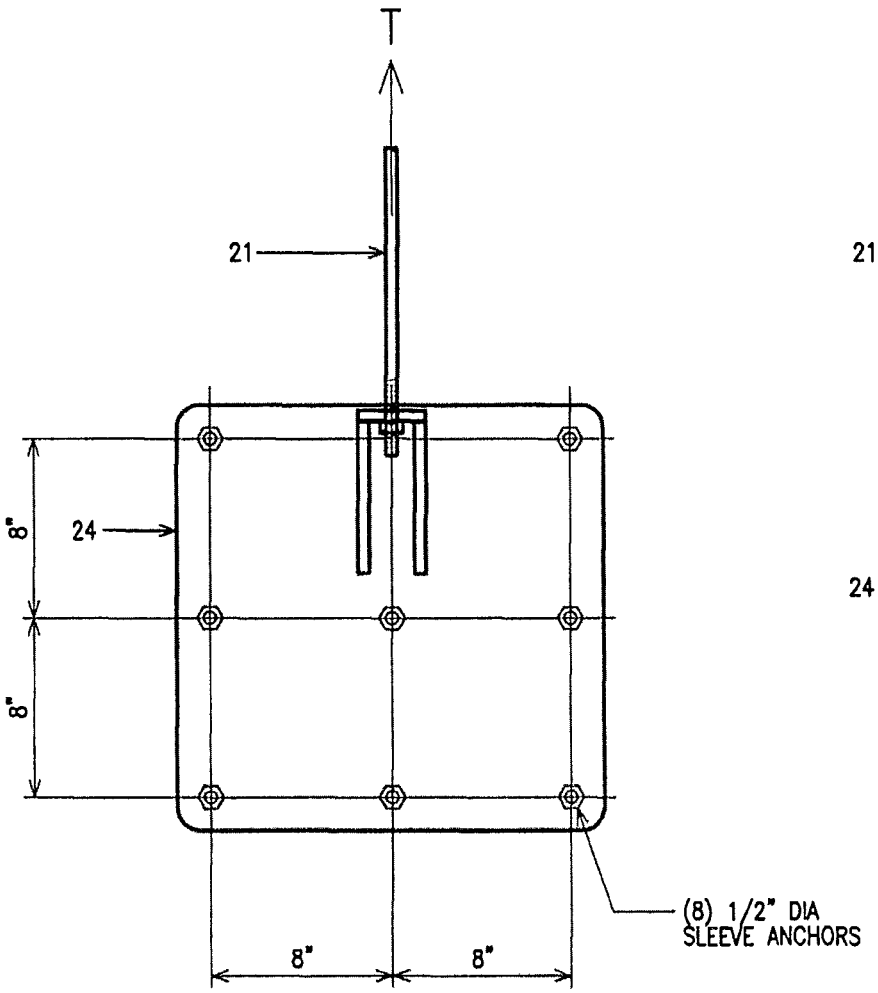
FIGS. 7A and 7A', 7B and 7B' and 7C and 7C' schematically illustrate respectively three different ultimate designs of the anchor plate and tension rod combinations of the present invention provided for corresponding different rod tension load requirements. the three different designs are each shown respectively in front elevation and side elevation.
Figure 7A:
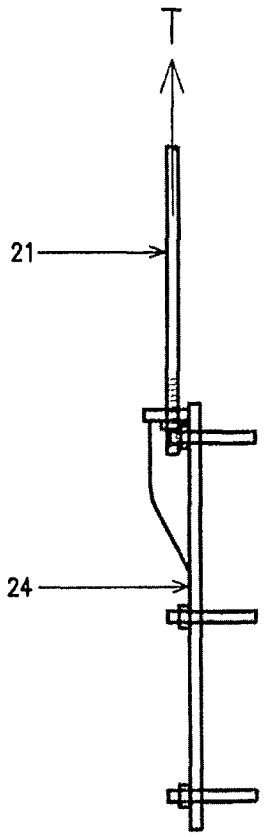
Figure 7B:
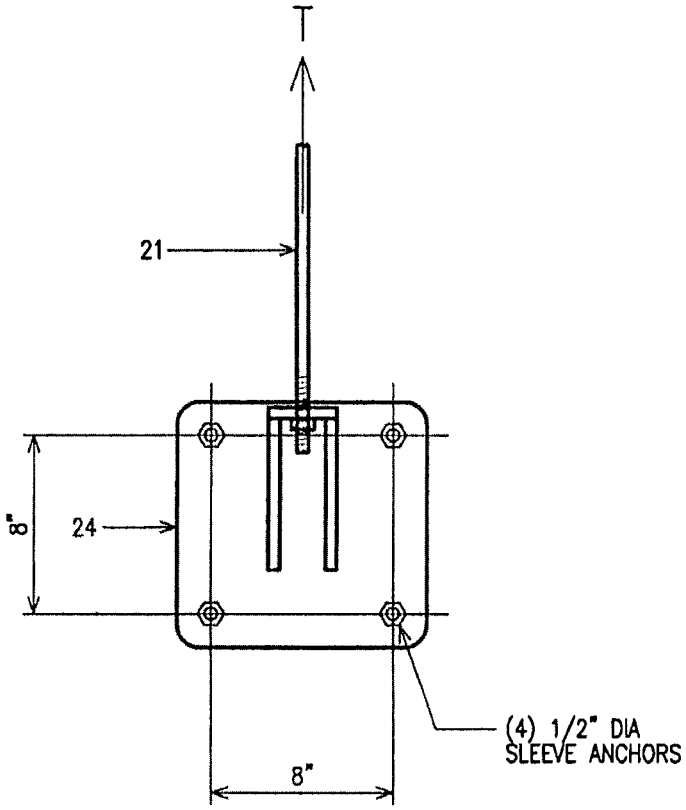
Figure 7B:
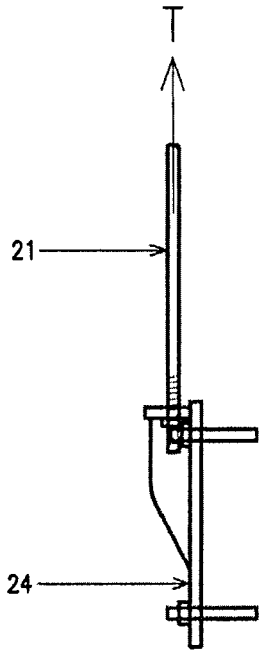
Figure 7C:
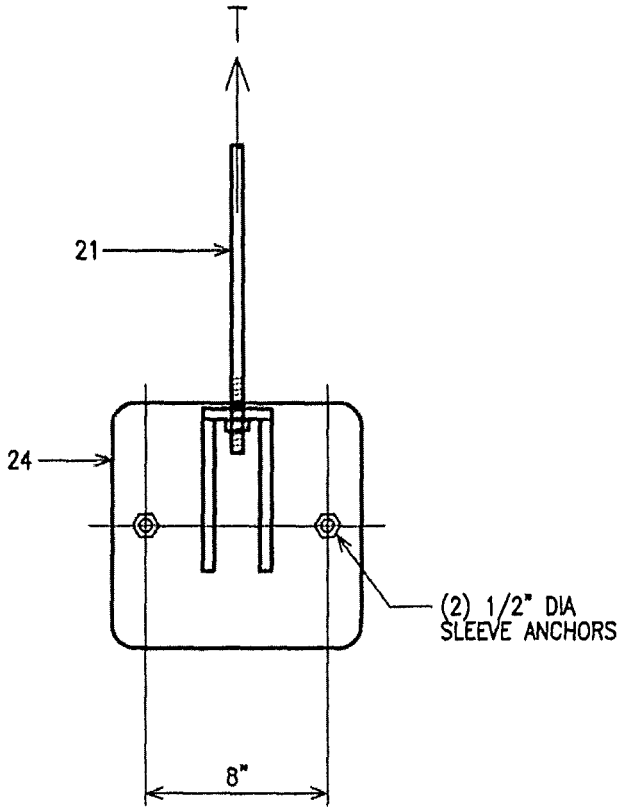
Figure 7C:
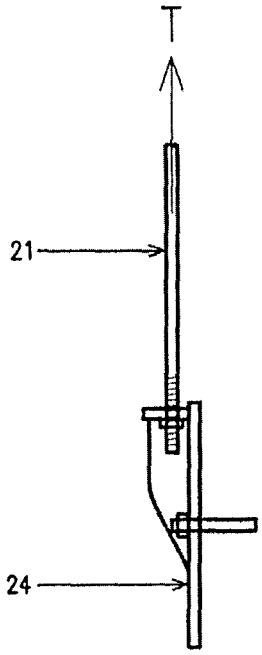

In this illustration, three different anchor designs are produced, one for a rod tension load of 8,000 pounds as represented by FIGS. 7A and 7A', one for a rod tension load of 4,000 pounds as represented by FIGS. 7B and 7W, and one for a rod tension load of 2,000 pounds as represented by FIGS. 7C and 7C'. In this manner the procedure is simplified as illustrated hereinafter.

First, this structural moment in the wall is calculated based on standard engineering principles and the existing physical conditions. The calculated moment is then converted to an equivalent unit tension force per linear foot of wall surface by simply dividing the moment by the block thickness. This is another standard engineering calculation.

Then, the anchor which is most appropriate for the wall condition is selected and the required anchor spacing based on the unit tension calculated in the previous step is calculated. Once again, this is a simple, standard engineering calculation.

This approach greatly simplifies the process of the present invention for the engineer and the contractor. This approach provides three different sets of rod sizes, anchor plate designs, and sleeve anchor requirements depending on the required tension capacity. To the contrary, prior art methods do not provide any method of determining what is required for a given situation.

I claim:

1. The method of repairing masonry and concrete retaining walls that are failing under lateral earth pressure applied to an outer wall surface of said failing wall, comprising:

securing upper and lower spaced anchor plates to an inner wall surface of said failing wall by respectively securing said anchor plates to said inner wall surface with at least one anchor bolt secured through an aperture in each of said anchor plates;

connecting a threaded steel tension rod between and respectively to said upper and lower anchor plates with nuts threadably secured to upper and lower ends of said threaded steel tension rod; and placing said threaded steel tension rod under a desired tension load to thereby apply an external tension force to said inner wall surface without applying bending stresses to said threaded steel tension rod by tightening at least one of said nuts.

2. The method of claim 1, wherein said at least one anchor bolt is selected from the group consisting of an expansion anchor bolt and an adhesive anchor bolt.

3. The method of claim 1, including calculating the required size of said threaded tension rod to overcome tension overstress on said inner wall surface of said failing wall by calculating the tension rod force per rod required to overcome said tension overstress on said inner wall surface of said failing wall, then calculating the required cross-sectional area of said threaded tension rod and selecting said tension rod from standard sizes by using known allowable tension stress for a given standard steel threaded rod size.

4. The method of claim 3, including also calculating the bolting requirements for an anchor-to-wall shear connection of said anchor plates to said inner wall surface by calculating the total anchor load and then selecting said at least one anchor bolt from a known shear capacity.

5. The method of claim 4, wherein said at least one anchor bolt is selected from a group consisting of an expansion anchor bolt and an adhesive anchor bolt.

6. The method of claim 1, including securing side-by-side multiples of the claimed anchor plate and tension rod combination to said inner wall surface of said failing wall.

7. The method of claim 1, providing multiple designs of the claimed anchor plate and tension rod combination for respective corresponding different tension rod tension load requirements, and selecting the combination design for securement to said inner wall surface which most closely fits the calculated rod tension load requirements.

8. An apparatus for repairing masonry and concrete retaining walls that are failing under lateral earth pressure, comprising:

upper and lower spaced anchor plates secured respectively to upper and lower inner surface areas of said failing wall with anchor bolts secured through apertures in said anchor plates; and an elongate threaded steel tension rod having opposite ends thereof respectively connected to said anchor plates and both of said opposite ends adjustably connected to a respective one of said anchor plates whereby said threaded steel rod is placed under a desired tension.

9. The apparatus of claim 8, wherein said at least one anchor bolt is an expansion anchor bolt or an adhesive anchor bolt.

* * * * *